US012102215B2

(12) United States Patent
Li et al.

(10) Patent No.: US 12,102,215 B2
(45) Date of Patent: Oct. 1, 2024

(54) HIGH MOBILITY CONTOURED PAD

(71) Applicant: Qore Performance, Inc., Sterling, VA (US)

(72) Inventors: Justin B. Li, McLean, VA (US); J. D. Willcox, McLean, VA (US)

(73) Assignee: Qore Performance, Inc., Knoxville, TN (US)

( * ) Notice: Subject to any disclaimer, the term of this patent is extended or adjusted under 35 U.S.C. 154(b) by 709 days.

(21) Appl. No.: 17/123,802

(22) Filed: Dec. 16, 2020

(65) Prior Publication Data

US 2021/0204679 A1 Jul. 8, 2021

Related U.S. Application Data

(60) Provisional application No. 62/951,524, filed on Dec. 20, 2019.

(51) Int. Cl.
*A45F 3/12* (2006.01)
*F41H 1/02* (2006.01)

(52) U.S. Cl.
CPC ..... *A45F 3/12* (2013.01); *A45F 2003/127* (2013.01); *F41H 1/02* (2013.01)

(58) Field of Classification Search
CPC ..... A45F 3/12; A45F 2003/127; F41H 1/02
See application file for complete search history.

(56) References Cited

U.S. PATENT DOCUMENTS

| | | | | |
|---|---|---|---|---|
| 10,420,412 | B1 * | 9/2019 | Schlofman | A45F 3/047 |
| 2002/0134805 | A1 * | 9/2002 | Preiss | A45F 3/12 224/264 |
| 2004/0173656 | A1 * | 9/2004 | Seong | A45F 3/04 224/644 |
| 2008/0283562 | A1 * | 11/2008 | Bergenudd | A61F 5/3738 224/264 |
| 2016/0037946 | A1 * | 2/2016 | Melcher | A47C 20/02 5/636 |

* cited by examiner

*Primary Examiner* — Alicia J Weydemeyer
*Assistant Examiner* — Laura B Figg
(74) *Attorney, Agent, or Firm* — DLA Piper LLP (US)

(57) ABSTRACT

A high mobility, contoured shoulder and hip pad that can address various needs for body armor, equipment belt, and other types of equipment-users as identified above. The pad is shaped such that the pad can disperse the weight of a body armor system or other load carrying system on the faces of the user's shoulder and trapezius muscle or hip area. The width of the pad can involve reduced dimensions at the middle portion of the pad relative to the width dimensions at the ends of the pad, such as e.g., having an hourglass shape.

19 Claims, 5 Drawing Sheets

HIGH MOBILITY CONTOURED PAD

CROSS-REFERENCE TO RELATED APPLICATION

This application claims priority to U.S. Provisional Application No. 62/951,524, filed Dec. 20, 2019, the contents of which are incorporated herein by reference in their entirety.

FIELD OF THE INVENTION

Embodiments disclosed herein include unique perforated pads for providing, among other things, supplemental load distribution, padding, impact protection, ventilation, and evaporative cooling to a user's body, particularly when the user is wearing body armor, backpacks, harnesses, equipment belts or other equipment/garments that are known to cause discomfort due to load, pressure heat retention or force. The embodiments described herein employ a unique geometric shape, which can facilitate an unusually wide range of motion and anatomical compatibility for a user when worn.

BACKGROUND OF THE DISCLOSURE

The use of body armor and equipment belts by military and law enforcement personnel is a common practice for protection against the many kinetic threats faced in the line of duty and to carry various life-saving tools in the field. To counter these threats, body armor and equipment belts tend to be heavy and fit close to the wearer's body. This close-to-body fit can impair mobility while also restricting air flow, which leads to significant heat retention. The mobility impairment can also increase fatigue, which in turn reduces survivability. In addition, the weight of body armor can place significant strain on the musculoskeletal system with particular emphasis on the shoulder muscles. In addition to reducing immediate survivability while on duty, over time, these stresses decrease career longevity and create long-term health risks with degraded quality of life in retirement. Eventually, these health risks create substantial costs which are later borne by the taxpayer in the form of disability payments. All of these consequences are undesirable.

SUMMARY

In one or more embodiments, a pad is provided. The pad comprises a material having first and second ends connected to a middle portion, the first end having a first width, the second end having a second width, and the middle portion having a third width, the third width being smaller than both the first and second widths.

In one or more embodiments, a shape of the material is an hourglass-like shape.

BRIEF DESCRIPTION OF THE DRAWINGS

Various objectives, features, and advantages of the disclosed subject matter can be more fully appreciated with reference to the following detailed description of the disclosed subject matter when considered in connection with the following drawings, in which like reference numerals identify like elements.

Figure 1:
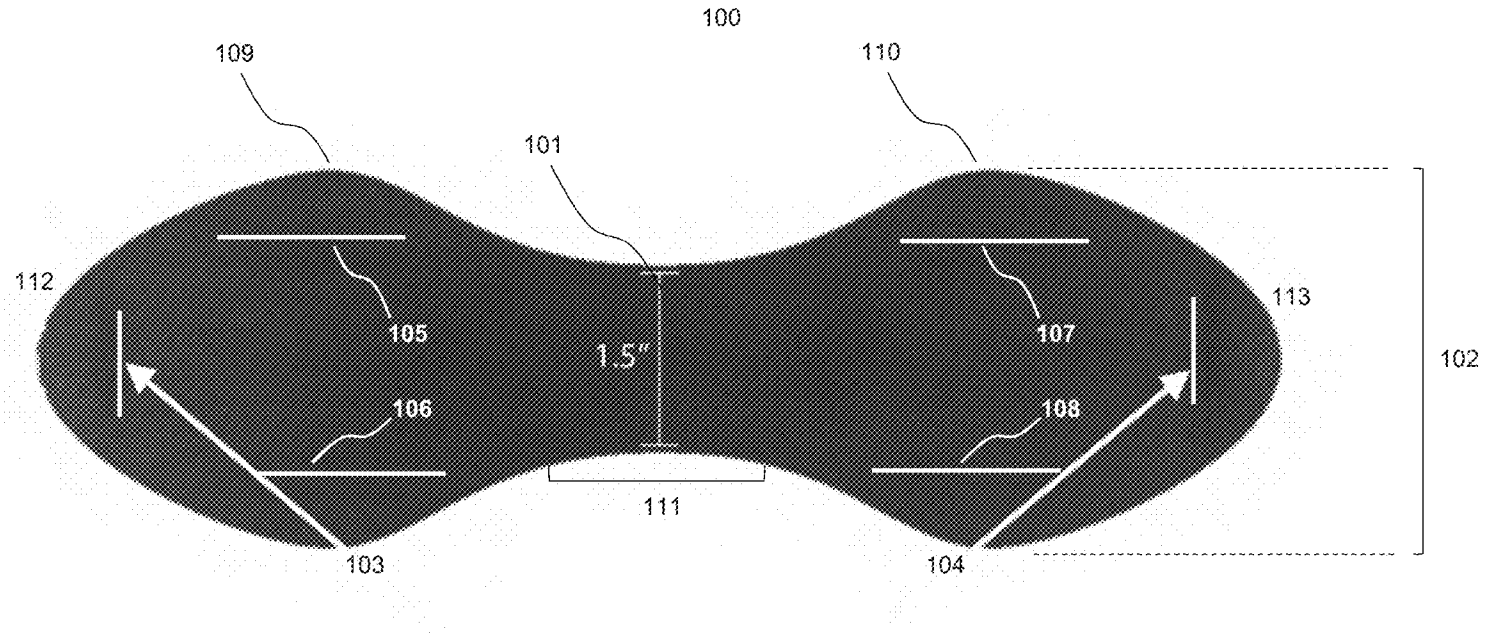
FIG. 1 shows a high mobility, contoured pad, according to some embodiments of the present disclosure.

The drawings are not necessarily to scale, or inclusive of all elements of a system, emphasis instead generally being placed upon illustrating the concepts, structures, and techniques sought to be protected herein.

DETAILED DESCRIPTION

The following detailed description is merely exemplary in nature and is not intended to limit the invention or the applications of its use.

There is a distinct need within the community of military and law enforcement body armor and equipment belt users for a shoulder pad that reduces the strain on the end users musculoskeletal groups without any impairment to mobility while also providing some stand-off for the body armor and equipment belts that facilitates ventilation and air flow to reduce heat retention. Combined, these benefits can significantly improve on the job survivability and long-term quality of life, in addition to reducing the financial burden on the taxpayer.

Embodiments of the present disclosure relate to a high mobility, contoured shoulder and hip pad (herein referred to as the "pad") that can address various needs for body armor, equipment belt, and other types of equipment-users as identified above. The pad is shaped such that the pad can disperse the weight of a body armor system or other load carrying system (e.g., backpack, shoulder bag, equipment belt, etc., or any other "over-the-shoulder" strap or "over-the-hip" strap) on the faces of the user's shoulder and trapezius muscle (the "trap") or hip area. The width of the pad can involve reduced dimensions at the middle portion of the pad relative to the width dimensions at the ends of the pad, such as e.g., having an hourglass shape. It should be appreciated that an hourglass shape is but one example and not specifically required. As described herein, the term "hourglass-like" shape can involve various shapes in which over a length of the pad, a width of the middle portion of the pad is less than the width of outside/other portions of the pad.

An hourglass-like shape can allow a user to experience a full range of motion for their arms when the pad is worn on the shoulder and a full range of motion for their legs when the pad is worn on the hips. The pad described herein can prevent discomfort on the body from the load-carrying systems, such as chafing, rubbing, and other resistance. Conventional shoulder and/or hip pads lack this contour or shape and do not accommodate the shoulder, arms, neck, and hips for users when they are engaged in load-bearing activities. A full or near-full range of motion can be vital for many tasks for a user, such as running, jumping, scaling fences/walls/obstacles, Military Freefall operations such as HALO (high altitude low opening) or HAHO (high altitude high opening), Static Line parachute operations, Fast Rope Insertion, Sniper/Sharpshooter/Precision Riflemen/Designated Marksmen, medical aid, signaling, climbing, rappelling, and more.

In some embodiments, the pad can also include various perforations. Perforations distributed throughout the pad can allow air to pass between the body and/or garment on the user and the body armor system (or other load-carrying system or pack) worn by the user. In some embodiments, the pad of the present disclosure can be soft and flexible and can include a four-way stretch to aid in the range of motion with reduced resistance without collapsing completely under load, which can permit ventilation while carrying equipment or a load. In some embodiments, the pad can also include one or more vents to further assist in air flow under the load. In some embodiments, the pad can be made from any number of materials with load-bearing properties. For example, the pad can be either a synthetic or natural material and can include, but is not limited to, foam, thermoplastic elastomer, polymer, honeycomb, mesh, cotton, polyester, etc.

FIG. 1 shows an example high mobility, contoured pad 100, according to some embodiments of the present disclosure. In some embodiments, pad 100 can have two ends 109, 110 connected by a middle portion 111. In some embodiments, the middle portion 111 of the pad 100 may have a first width 101 and the ends 109 and 110 may have a second width 102 forming an hourglass-like shape. In the illustrated example, the first and second ends 109, 110 have a reduced width at their respective outermost portions 112 and 113, forming oblong shaped ends. As can be appreciated, the shape of the ends 112, 113 need not be oblong shaped (see e.g., FIG. 2). The first width 101 is smaller than the second width 102. In some embodiments, the first width 101 can be between about 1.5 inches and 2 inches, such as e.g., 1.75 inches. In the illustrated embodiment, the first width 101 is 1.5 inches. In some embodiments, the second width 102 can be about 3 inches. It should be appreciated that the ends 109, 110 of the pad 100 are not required to have the same width; all that is required is that they are both wider than the first width 101. The reduction in width in the middle portion 111 of the pad 100 can allow for any loads being carried to be dispersed or spread out and can provide a greater range of motion in comparison to conventional pads, as well as reduced chafing and friction on a user at the middle of the pad 100. In some embodiments, the total length of the pad 100 can be around 10 inches, such as e.g., 10.5 inches. It should be appreciated that the actual dimensions of the pad are not limiting and that the disclosed principles merely require a middle portion 111 that is substantially smaller in width than the ends 109, 110. In FIG. 1, the width of the middle portion 111 is about one and a half inches smaller than the widths of the ends 109, 110.

In some embodiments, pad 100 can include a plurality of slits 103-108. Each of the slits 105-108 can provide a mounting point for the pad 100 to be attached to various body armor systems and backpacks. For example, the slits 103-108 can be configured to receive various straps and or other mounting mechanisms of a variety of materials (see e.g., FIG. 5). For example, straps and attachment mechanisms can include both natural and synthetic materials, such as nylon, hook/loop, OneWrap, cotton, cord, modular lightweight load-carrying equipment (MOLLE), etc.

Figures 2, 3, 4:
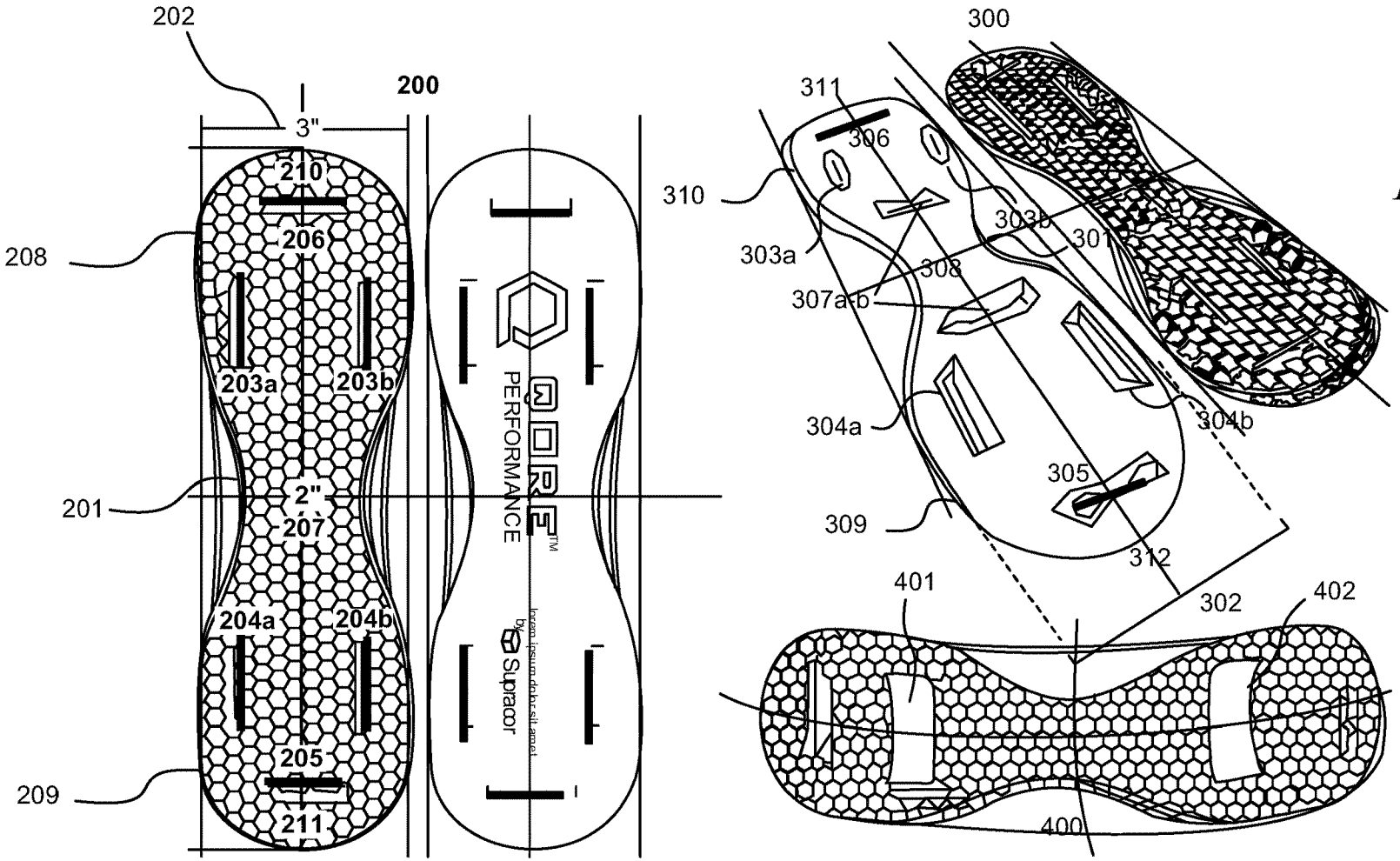
FIGS. 2 and 3 each show top and bottom views of high mobility, contoured pads, according to some embodiments of the present disclosure.
FIG. 4 shows another high mobility, contoured pad, according to some embodiments of the present disclosure.

FIGS. 2 and 3 each show top and bottom views of example high mobility, contoured pads 200, 300, according to some embodiments of the present disclosure. FIG. 2 shows the top and bottom of pad 200. The illustrated pad 200 is similar to pad 100 of FIG. 1, but with rounder outermost end portions 210, 211, forming substantially uniform ends 208, 209. As shown in FIG. 2, the pad 200 can include a first width 201 and a second width 202, where width 201 is smaller than width 202. In some embodiments, width 201 can be approximately 1.75 inches and width 202 can be approximately 3.25 inches. In addition, pad 200 can include a first set of vertical slits 203*a-b* and a second set of vertical slits 204*a-b*. Pad 200 can also include a set of horizontal slits 205 and 206. These slits can, similar to in FIG. 1, be configured to receive various mounting mechanisms and attach to a load carrying system or body armor system. For example, a user wearing a body armor system could attach pad 200 to the underside of the shoulder strap of the body armor system. This attachment of pad 200 can reduce chafing, preserve the user's range of motion, disperse the load of the body armor, and provide ventilation which can reduce heat retention. In the illustrated example, the width 201 of the middle portion 207 is 2 inches and the width 202 of the ends 208, 209 is 3 inches. As noted above, other dimensions of the pad may include a width 201 of 1.75 inches, a width 202 of 3.25 inches and overall length of 10.5 inches. As noted above, the ends 208, 209 do not have to have the same width.

With respect to FIG. 3, pad 300 can include similar dimensions and slits as pads 100 and 200, such as first width 301 of a middle portion 308 that is smaller than the second width 302 of ends 309, 310, each end including a respective outermost end portion 311, 312 that can be rounded (as shown) or oblong shaped. In addition, pad 300 can include a first set of vertical slits 303*a-b*, a second set of vertical slits 304*a-b*, a first set of horizontal slits 305, 306 and a second set of horizontal slits 307*a-b*.

FIG. 4 shows another high mobility, contoured pad 400, according to some embodiments of the present disclosure. In the illustrated example, the pad 400 includes straps 401 and 402 inserted through slots of the pad.

Figure 5A:
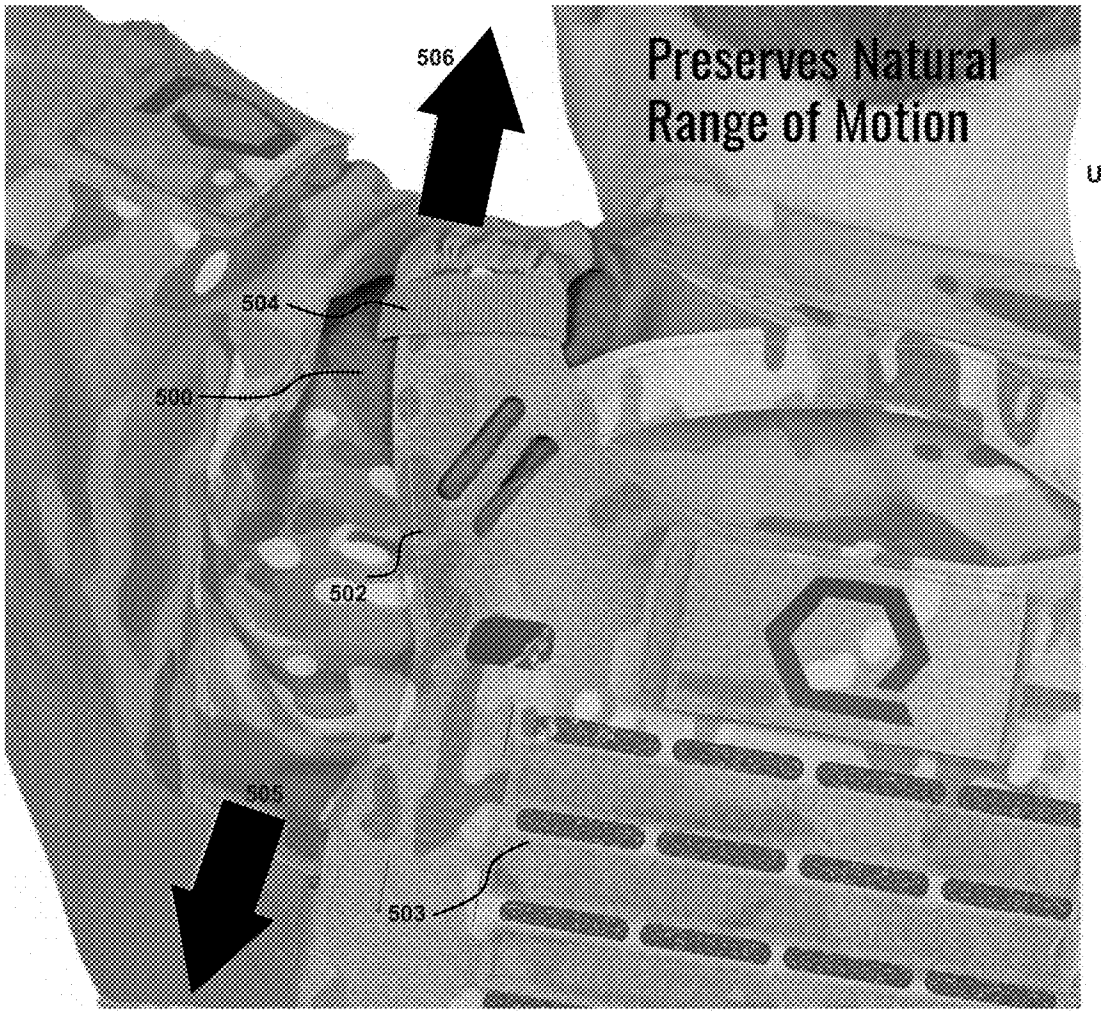
FIGS. 5A-5B show a user wearing a high mobility, contoured pad, according to some embodiments of the present disclosure.
Figure 5B:
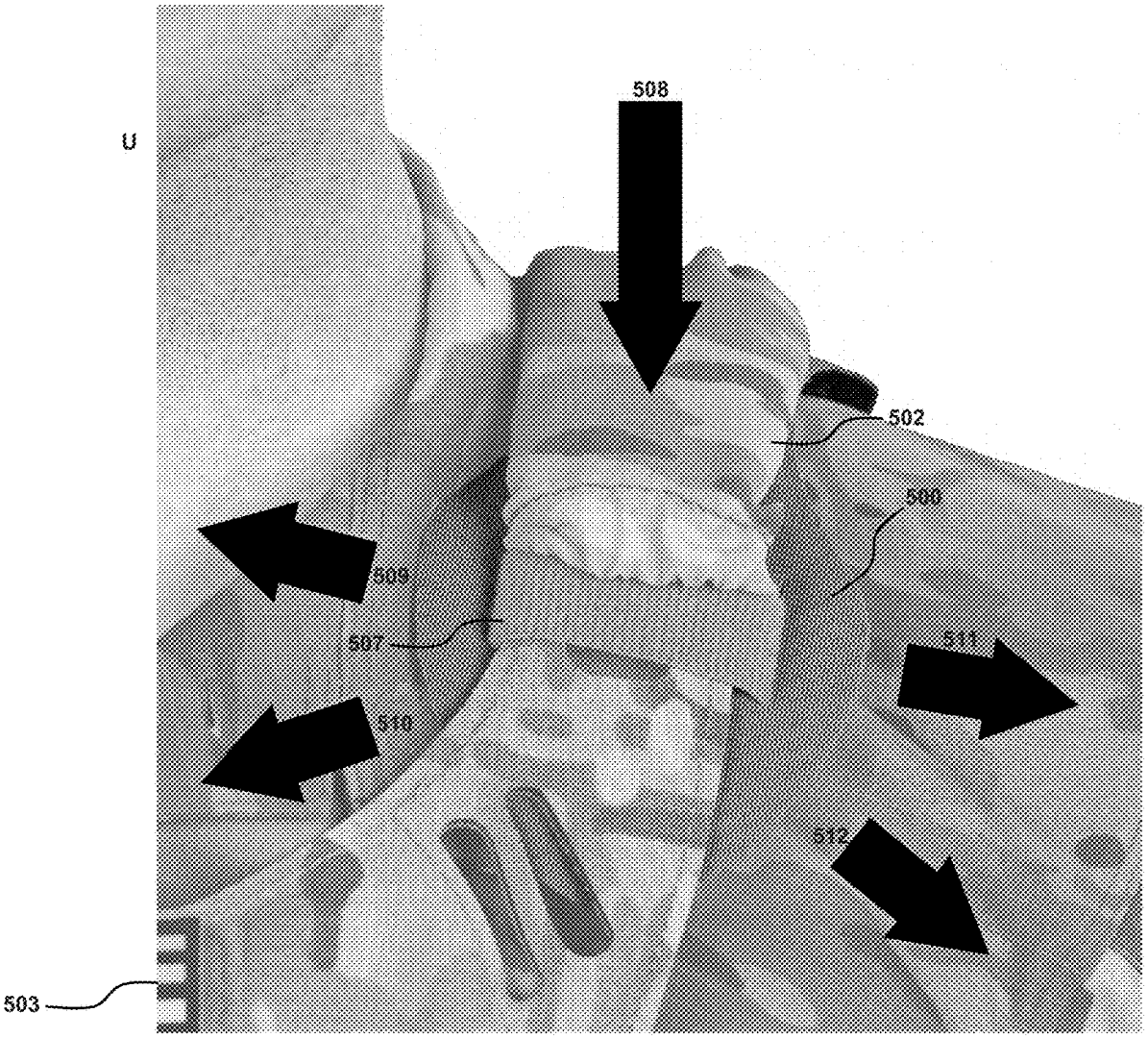

FIGS. 5A-5B show a user U wearing an example high mobility, contoured pad 500, according to some embodiments of the present disclosure. In FIG. 5A, a back view of user U is shown while a front view of the user U is shown in FIG. 5B. In the illustrated example, the user U is wearing an exemplary body armor system that includes body armor section 503 and a strap 502 that allows the user U to wear the body armor system like a backpack. The pad 500, via various slits (not shown), is shown as being attached or connected to the underside of the strap 502 of the body armor system. For example, a strap of fabric or hook and loop material (e.g., Velcro) 504 can be looped through slits on the pad 500 to facilitate the attachment. The middle portion of the pad 500 (e.g., the section with the reduced width) can rest approximately centered on the user's shoulder, providing a greater range of motion in the downwards direction (see arrow 505) and the upwards direction (see arrow 506). The narrower middle portion of the pad 500 can also prevent chafing on the neck of the user U and manage/disperse the load of the body armor system which can make it more comfortable on the shoulders.

As shown in FIG. 5B, a second strap of fabric or hook and loop material (e.g., Velcro) 507 may be looped through additional slits (not shown) on the front side of the pad 500. Arrow 508 illustrates the downward force of the body armor system and arrows 509-512 indicate that air flow between the pad 500 and the user's U shoulder is achieved in multiple directions, which can prevent significant heat retention.

Figure 6:
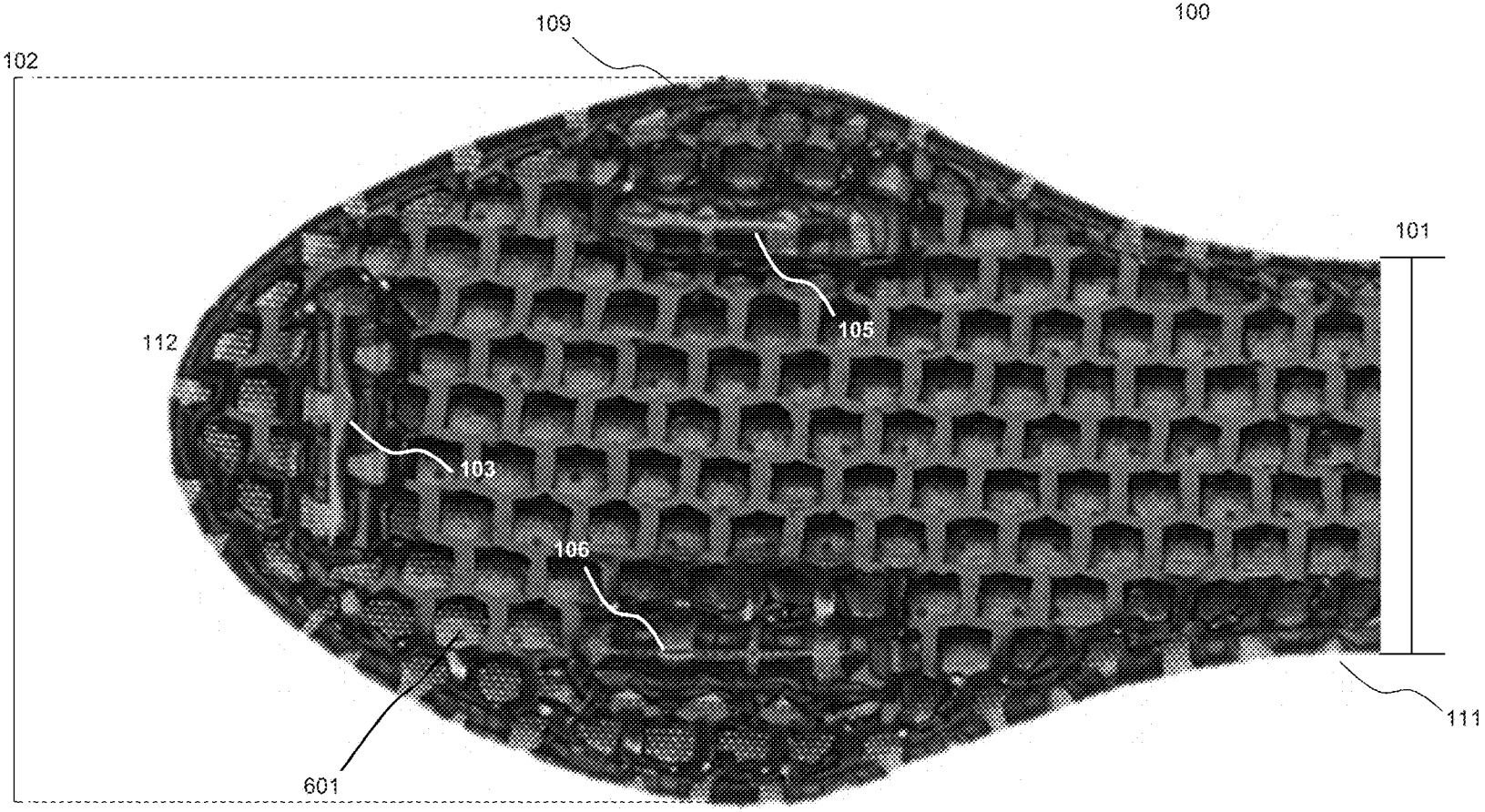
FIG. 6 shows a zoomed-in view of the underside of the high mobility, contoured pad of FIG. 1, according to some embodiments of the present disclosure.

FIG. 6 shows a zoomed-in view of the underside of the high mobility, contoured pad 100 of FIG. 1, according to some embodiments of the present disclosure. When referring to "underside", the present disclosure refers to the side that can rest on the shoulder of a user to provide comfort, while the opposite side is shown in FIG. 1. As noted above, the pad 100 can include a middle portion 111 with a first width 101 and an end 109 with a second width 102, as well as an outermost portion 112. various straps or belts can be received by the slits 103, 105, and 106 for attaching the pad to user worn equipment. Pad 100 can also include a honeycomb configuration similar to the one shown in FIGS. 2-4. Such a configuration can include a plurality of vents (e.g., vent 601) or hollowed out portions within the pad 100 to provide ventilation and cooling to a user while the pad 100 is being worn as discussed above. It should be appreciated that a honeycomb configuration and corresponding hexagonal vents are not required and any shape of vent 601 could function to cool the user while still providing the necessary padding and comfort.

It should be appreciated that the dimensions described herein are merely exemplary in nature and do not limit the embodiments described herein. Furthermore, any thickness of the pad can be used according to one's desired level of comfort or as traditional used in the field. For example, the pad can be approximately an eighth (⅛) of an inch thick. In addition, while the embodiments described herein may be ideal for military and law enforcement, they are not limited to these environments and can find usefulness in a variety of other fields where range of motion and comfort can be increased using one of the disclosed pads.

While various embodiments have been described above, it should be understood that they have been presented by way of example and not limitation. It will be apparent to persons skilled in the relevant art(s) that various changes in form and detail may be made therein without departing from the spirit and scope. In fact, after reading the above description, it will be apparent to one skilled in the relevant art(s) how to implement alternative embodiments. For example, other steps may be provided, or steps may be eliminated, from the described flows, and other components may be added to, or removed from, the described systems. Accordingly, other implementations are within the scope of the following claims.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the disclosed subject matter. It is important, therefore, that the claims be regarded as including such equivalent constructions insofar as they do not depart from the spirit and scope of the disclosed subject matter.

In addition, it should be understood that any figures which highlight the functionality and advantages are presented for example purposes only. The disclosed methodology and system are each sufficiently flexible and configurable such that they may be utilized in ways other than that shown.

Although the term "at least one" may often be used in the specification, claims and drawings, the terms "a", "an", "the", "said", etc. also signify "at least one" or "the at least one" in the specification, claims and drawings.

Finally, it is the applicant's intent that only claims that include the express language "means for" or "step for" be interpreted under 35 U.S.C. 112(f). Claims that do not expressly include the phrase "means for" or "step for" are not to be interpreted under 35 U.S.C. 112(f).

Although the disclosed subject matter has been described and illustrated in the foregoing illustrative embodiments, it is understood that the present disclosure has been made only by way of example, and that numerous changes in the details of implementation of the disclosed subject matter may be made without departing from the spirit and scope of the disclosed subject matter.

The invention claimed is:

1. A pad comprising:

a material having first and second ends connected to a middle portion, the material comprising a plurality of honeycomb vents configured to provide ventilation to a user wearing the pad, the material further comprising a set of vertical slits and a set of horizontal slits; and the first end having a first width, the second end having a second width, and the middle portion having a third width, the third width being smaller than both the first and second widths.

2. The pad of claim 1, wherein a shape of the material is an hourglass-like shape.

3. The pad of claim 1, wherein the first and second widths are the same.

4. The pad of claim 1, wherein the first and second widths are different.

5. The pad of claim 1, wherein the material further comprises:

a plurality of slits configured to receive a load bearing strap;

wherein the pad is configured to rest on a user's body and allow airflow between a shoulder of the user and the pad when strapped to equipment worn by the user.

6. The pad of claim 1, wherein the pad is configured to attach to an over-the-shoulder strap and rest on the user's shoulder.

7. The pad of claim 1, wherein the pad is configured to attach to an over-the-hip strap and rest on a hip of the user.

8. The pad of claim 1, wherein at least a portion of the material is perforated.

9. The pad of claim 1, wherein the first and second widths are at least 3 inches and the third width is between about 1.5 inches and 2 inches.

10. The pad of claim 1, wherein the material comprises a four-way stretch material.

11. The pad of claim 1, wherein the material comprises at least one of foam, a thermoplastic elastomer, a polymer, cotton, or polyester.

12. The pad of claim 1, wherein the material has a thickness of about an eighth of an inch.

13. A pad comprising:

a material having first and second ends connected to a middle portion, the material comprising a plurality of honeycomb vents configured to provide ventilation to a user wearing the pad, the material further comprising a set of vertical slits and a set of horizontal slits; and the first end having a first width, the second end having a second width, and the middle portion having with a third width, the third width being smaller than both the first and second widths and defining an hourglass-like shape.

14. The pad of claim 13, wherein at least one of the set of vertical slits or the set of horizontal slits is configured to receive a load bearing strap;

wherein the pad is configured to rest on the user's body and allow airflow between a shoulder of the user and the pad when strapped to equipment worn by the user.

15. The pad of claim 14, wherein the pad is configured to attach to an over-the-shoulder strap and rest on the user's shoulder.

16. The pad of claim 14, wherein the pad is configured to attach to an over-the-hip strap and rest on a hip of the user.

17. The pad of claim 13, wherein at least a portion of the material is perforated.

18. The pad of claim 13, wherein the material comprises a four-way stretch material.

19. The pad of claim 13, wherein the material comprises at least one of foam, a thermoplastic elastomer, a polymer, cotton, or polyester.

* * * * *